US005344018A

United States Patent [19]

Severin

[11] Patent Number: 5,344,018

[45] Date of Patent: Sep. 6, 1994

[54] DISPENSING PACKAGE ASSEMBLY

[75] Inventor: Jane E. Severin, Wonder Lake, Ill.

[73] Assignee: Pitman-Moore, Inc., Mundelein, Ill.

[21] Appl. No.: 891,694

[22] Filed: Jun. 1, 1992

[51] Int. Cl.[5] ..... B65D 35/56; B65D 85/14

[52] U.S. Cl. ..... 206/469; 206/277; 222/1; 222/94

[58] Field of Search ..... 206/461–471, 206/219, 277; 220/359; 222/1, 92–97, 105–107, 395; 383/210

[56] References Cited

U.S. PATENT DOCUMENTS

| | | | |
|---|---|---|---|
| 2,898,208 | 8/1959 | Land et al. | 222/107 |
| 3,301,395 | 1/1967 | Swezey . | |
| 3,635,376 | 1/1972 | Hellstrom . | |
| 3,913,734 | 10/1975 | Siegel . | |
| 4,058,220 | 11/1977 | Torongo | 206/461 |
| 4,155,454 | 5/1979 | Ryden . | |
| 4,210,246 | 7/1980 | Kuchenbecker | 206/461 |
| 4,300,682 | 11/1981 | Kuchenbecker | 206/470 |
| 4,592,493 | 6/1986 | Smith . | |
| 4,648,506 | 3/1987 | Campbell . | |
| 4,830,205 | 5/1989 | Hammond et al. . | |
| 4,856,651 | 8/1989 | Francis, Jr. | 206/219 |
| 4,921,137 | 5/1990 | Heijenga . | |
| 4,935,283 | 6/1990 | Jamison . | |
| 5,038,974 | 8/1991 | De Costa | 222/106 |

FOREIGN PATENT DOCUMENTS

| | | | |
|---|---|---|---|
| 0247226 | 5/1966 | Austria | 206/219 |
| 1234510 | 2/1967 | Fed. Rep. of Germany | 206/461 |
| 2832749 | 2/1980 | Fed. Rep. of Germany | 206/461 |
| 1081502 | 8/1967 | United Kingdom | 206/461 |
| 2047087 | 11/1980 | United Kingdom | 206/219 |

*Primary Examiner*—Jimmy G. Foster
*Attorney, Agent, or Firm*—Wendell Ray Guffey; Penny R. Slicer; Thomas L. Farquer

[57] ABSTRACT

A dispensing package assembly useful for dispensing a predetermined amount of a fluent material comprises a relatively stiff base sheet, a blister overlay appended to the overlay and a dispenser pouch housed within the confines of the overlay and the sheet. The blister overlay having a main cavity and a secondary cavity includes a dispenser depression, preferably in the shape of a thumb indention, which protrudes downward into the main cavity. A shearing depression extending laterally through the secondary cavity defines an area of reduced depth within the secondary cavity. The main body of the pouch is located within the overlay main cavity having a dispensing channel or passageway extending therefrom beneath the shearing depression and into the secondary cavity.

24 Claims, 1 Drawing Sheet

2
4
6
8
10
12
14
16
18
20
22
24
26
28
30
32
34
36
38
40
42
44

DISPENSING PACKAGE ASSEMBLY

BACKGROUND OF THE INVENTION

1. Field of the Invention

The present invention relates in general to a dispensing package assembly, and more particularly, relates to an improved package for safely containing and dispensing a pre-determined amount of fluent material.

2. Description of the Related Art

A variety of packaging systems have heretofore been developed in the art for dispensing a pre-determined dosage amount of a fluent material onto a substrate. Particularly when dispensing single doses of a pharmaceutical, biological or pesticidal formulation, the full dosage amount need be delivered with accuracy while preventing contact between the material being applied and the user/applicator.

Glass ampoules including a dropper system have been used extensively in the past to dispense a measured amount of a fluent composition onto a patient or other substrate, but these ampoules are relatively inconvenient to transport, store and use in addition to posing the risk of breakage at any time during distribution and use.

Plastic packets have also been developed for dispensing a pre-determined amount of fluent material. Although these packets are relatively more convenient and safe than the glass ampoules heretofore mentioned, the user/applicator is generally required to handle the packet extensively, often times manually squeezing the packet to completely the expel material. There is a substantial risk that the user will come into contact with the contained material by handling the packet in this manner. In addition, the flexible packets are not well suited for directing the contained material to a desired point of application or to spreading the material upon being applied.

Another problem encountered with single dose packages heretofore developed in the art is that the packages are too small to have all the necessary product information, instructions and warnings printed thereon. Government regulations, however, frequently require that this information be presented on the package itself and it is desirable to include such information so that it is immediately available to the user/applicator during the application process.

It is thus an object of the present invention to provide a dispensing package assembly for safely and conveniently storing and dispensing a pre-determined amount of a fluent material.

It is another object of the present invention to provide a dispensing package assembly wherein product information and labeling is provided on the package assembly.

It is a further object of the present invention to provide a dispensing package assembly that protects the user from contact with the primary container and the material contained therein while the material is being dispensed.

It is another object of the present invention to provide a dispensing package assembly for containing a single dose of a pharmaceutical, biological or pesticidal formulation that is relatively easy to use and that protects the user from contact with the formulation.

A further object of the present invention is to provide a dispensing package assembly containing a pre-determined dose of a pesticidal formulation for direct application to an animal.

It is yet another object of the present invention to provide a dispensing package assembly for dispensing a pre-determined dosage amount of a fluent material wherein the assembly is relatively convenient to transport, distribute and use and is aesthetically pleasing to the eye.

SUMMARY OF THE INVENTION

These and other objects are achieved by a dispensing package assembly that is particularly useful for dispensing a pre-determined amount of a fluent material onto an application area. The assembly generally comprises a relatively stiff base sheet, a blister-type overlay secured onto the base sheet and a dispenser pouch housed within the confines of the overlay and the sheet. The blister overlay includes a main cavity and a secondary cavity wherein a dispenser depression, preferably in the shape of a thumb indention, protrudes downward into the main cavity and a shearing depression extends laterally through the secondary cavity to define an area of reduced depth within the secondary cavity. The pouch comprises a main body substantially housed within the main cavity of the overlay, and a dispensing channel extending from the main body beneath the shearing depression and into the secondary cavity.

To dispense the contained material, the user first shears across the base sheet, through the overlay and the pouch channel along the shearing depression. The material is then dispelled through the opened channel by pressing upon the dispensing depression to compress the main body of the pouch.

In a preferred embodiment, the package assembly includes a cover sheet connected to the base sheet along at least one fold line, wherein the cover sheet may be folded along the fold line into an opposed or overlying position with the base sheet. In this manner, the cover sheet protects the overlay, pouch and materials contained therein from physical or environmental damage. Means for releasably securing the cover sheet in the overlying position with the base sheet may be provided to assure that the assembly remains closed for transport, storage and display. In addition, the cover sheet may include a blister overlay and dispenser pouch as heretofore described such that upon folding the cover sheet into an overlying position with the base sheet, the blister overlays are positioned adjacent one another and sandwiched between the base and cover sheets.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figures 1, 2, 3, 4:
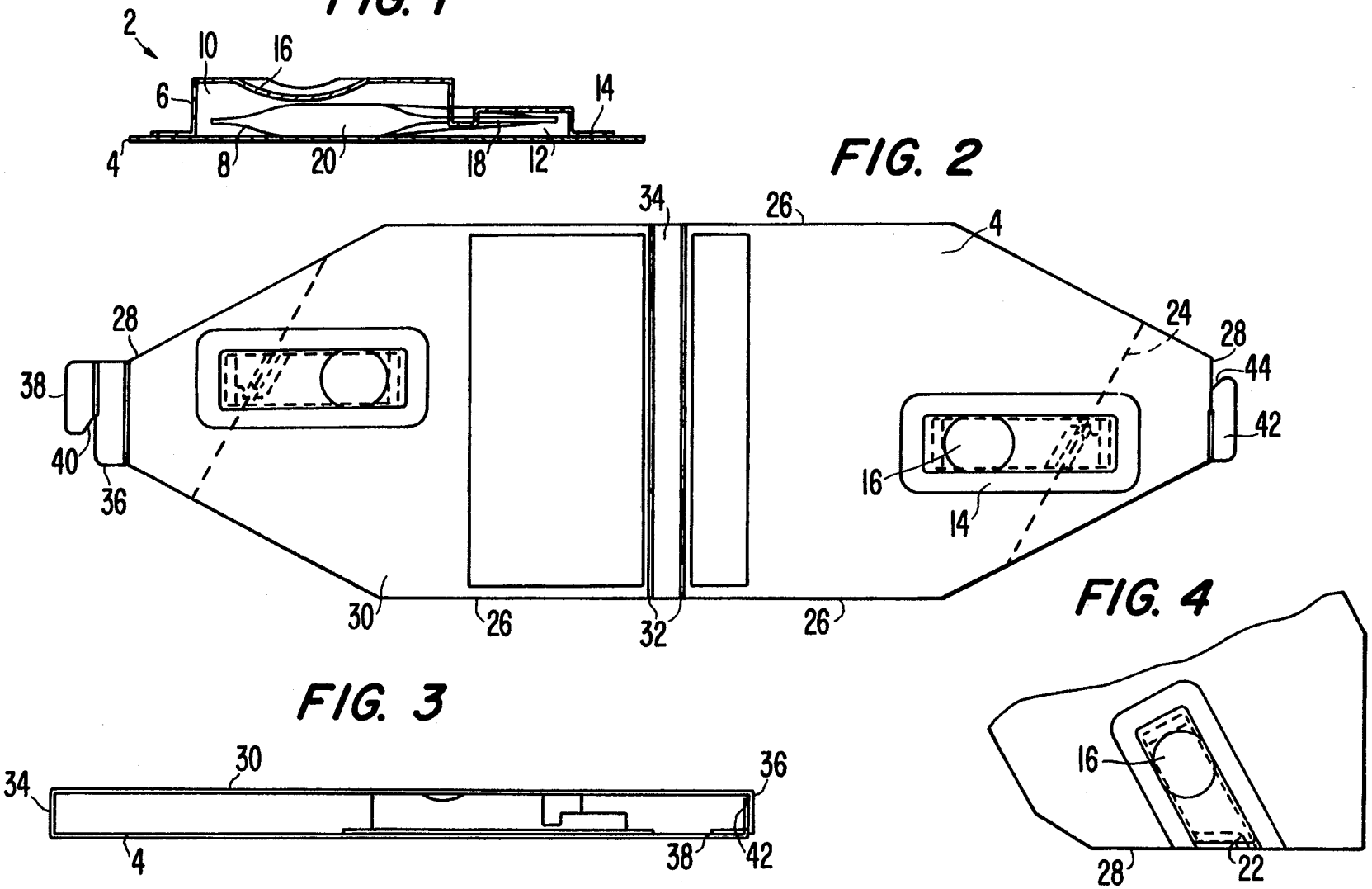
FIG. 1 is a side elevational view of a dispensing packaging assembly made in accordance with the present invention.
FIG. 2 is a top plan view of one embodiment of the present invention wherein the dispensing package assembly comprises a base and cover sheet connected along first and second fold lines, each sheet including a blister overlay and dispensing pouch.
FIG. 3 is a side elevational view of FIG. 2, wherein the sheets are folded along first and second fold lines into an opposed position to close the assembly.
FIG. 4 is a top plan view of a dispensing package assembly made in accordance with the present invention and in an inverted position for application having been sheared along a line through the secondary cavity.

The dispensing package assembly of the present invention is identified generally by the numeral 2 and as best shown in FIG. 1, principally comprises a base sheet 4, a blister-type overlay 6 appended to the base sheet and a dispensing pouch 8 housed within the confines of base sheet 4 and overlay 6. The base sheet 4 may be formed from any number of pliable, relatively stiff materials on which printing or other indicia may be placed, and preferably comprises a relatively stiff foldable supporting sheet of paperboard or the like. The sheet may be laminated or otherwise treated to protect it from water or wear damage.

The blister-type overlay 6 having a main cavity 10 and secondary cavity 12 opening into main cavity 10 includes a peripheral flange 14 so that it can be attached to sheet 4 to close the cavities. Any appropriate means such as heat fusion, heat-sealed coating or adhesives may be used to attach the flange to the sheet. A dispensing depression 16 on the upper face of overlay 6 protrudes downward into main cavity 10 in proximity with the main body of pouch 8 as hereafter described. The dispensing depression 16 is configured as a portion of a sphere, preferably the size of an average human thumb print, and extends into the sidewalls of main cavity 10 to weaken the sidewalls or make them more flexible at the dispensing depression. The secondary cavity 12, having less depth than that of the main cavity 10, includes a shear depression 18 which extends laterally through a portion of the secondary cavity to thereby define an area of reduced depth within the secondary cavity and forming a lateral channel on the upper face of the overlay extending to an edge of the secondary channel. The shear depression 18 is preferably located immediately adjacent the main cavity 10.

The overlay 6 is constructed of a resilient deformable material and is preferably molded from a relatively heavy plastic film such as polyvinyl chloride or the like.

Dispenser pouch 8 generally comprises a main body 20 having an interior containment region for containing fluent materials and a closed dispensing channel 22 extending outwardly from and opening into main body 20 such that materials contained within the containment region can flow along the closed channel. The pouch 8 having a length and width to be received within the overlay 6 is arranged such that main body 20 is housed substantially within the confines of main cavity 10 and the channel 22 extends below shear depression 18 and into the secondary cavity 12. With this arrangement, an imaginary line drawn along the shear depression 18 will intersect the closed channel 22. The pouch may be secured in position by attaching the pouch to base sheet 4 by heat sealing or adhesive means, however in the preferred embodiment as shown FIG. 1, the pouch is generally prevented from slipping out of the main cavity by the shear depression 18 having a reduced depth.

The pouch 8 containing fluent material is constructed from a selected flexible plastic or laminate having heat seal characteristics. In general, the pouch may be formed from a plastic tube or two sheets of flexible material, wherein the pouch is partially peripherally sealed to form a containment region and is then filled with fluent material. The pouch is finally sealed along an end closure to confine the material within the pouch. Various methods for forming the dispensing channel 22 are known in the art including integrally forming the channel with the end closure by hermetic sealing or dialectic welding techniques. A suitable pouch includes the dispenser described in U.S. Pat. No. 4,592,493 to Smith which is hereby incorporated by reference.

In practice, the dispensing channel 22 is opened to dispense the material contained in the pouch by shearing a portion of base sheet 4, overlay 6 and channel 22 along shear depression 18. The reduced thickness of the shear depression 18 makes cutting relatively easy. Holding the opened assembly as shown inverted in FIG. 4, in hand, the user presses upon dispensing depression 16 with the thumb for example to compress the pouch 8 and force the contained material to extrude completely through the opened channel 22 onto the application area. In the inverted position, the channel 22 may slip downward slightly along the portion of the secondary cavity adjacent the shearing depression 18 such that the material being dispensed will be cleared from contacting the underlying sheet 4. In addition to accuracy of delivery, this assemblage makes it possible for the user to dispense and apply the material with little or no risk of getting the material on the user's hands or elsewhere.

Looking to FIG. 2, shear line indicia 24 extending below the shear depression 18 and laterally across the sheet 4 at an angle may be provided to further assist the user in shearing the assembly. As shown in FIG. 4, it is preferred that the sheet be sheared along the shear line indicia 24 completely and that the sheared portion be disposed of thus providing a more useful dispensing tool. The stiff base sheet having lateral sides 26 that are tapered inwardly at the application end 28 is particularly suited for handling in this manner and ensures that the material is safely applied with accuracy.

FIGS. 2 and 3 show a preferred embodiment of the present invention wherein the package assembly 2 additionally comprises a cover sheet 30 connected at one end along first and second fold lines 32 to the base sheet 4. The cover sheet 30 is generally configured as a mirror image of base sheet 4, wherein the lateral sides 26 of the cover sheet and base sheet are tapered inward toward free ends 28. The cover sheet 30 is placed in an opposed or overlying position with the base sheet 4 by folding along first and second fold lines 32 which are offset a distance from one another to define a spine or back binding 34 when the assembly is "closed". The distance between the fold lines 32 is preferably at least as great as the depth of the overlay main cavity 10 to prevent the overlay 6 from being crushed by cover sheet 30.

The free ends 28 of cover sheet 30 and base sheet 4 may be releasably secured together in the overlying position to form a closed assemblage that is particularly suited for transporting and distributing the assembly. Although various means for securing ends 28 may be provided, in a preferred embodiment, spacer flap 36 extending outward from the free end 28 of cover sheet 30 a distance at least as great the width of back binding 34, is connected along a fold line to the free end 28 of the cover sheet. First tab 38 connected along a fold line to spacer flap 36 includes a first slot 40 extending across a portion of the fold line. A second tab 42 connected along a fold line to the free end 28 of base sheet 4 includes a second slot 44 extending across a portion of the fold line, wherein the second slot 44 extends in a direction opposite that of first slot 40 to permit the tabs to interlock for secure attachment.

As shown in FIG. 1, a blister-type overlay 6 and dispensing pouch 8 as heretofore described may additionally be included on the cover sheet 30 and positioned in a manner such that the overlays of the cover sheet 30 and the base sheet 4 are presented side by side adjacent one another and sandwiched between the two sheets. The overlay 6 and pouch 8 are positioned on the sheets such that the secondary cavity 12 and the dispensing channel 22 of each are nearest the tapered free end of each sheet for application.

The dispensing package assembly as heretofore described provides a convenient and safe package for use in dispensing a pre-measured amount of a fluent material onto a person, animal or substrate. Indicia may be printed on both faces of the base sheet and cover sheet including product information, such that all needed instructions and warnings are immediately available to the user during the application process. By pressing upon the depression formed in the blister-type overlay, the material can be immediately and completely expelled to a localized application region without the user being required to handle the primary pouch container. The base sheet cut at an angle serves as an application tool and aids in spreading the material being applied to the desired areas. The shear depression not only assists the user in shearing the package, but also prevents the pouch from slipping entirely out of the main cavity of the overlay. When the pouch has been completely evacuated, the entire package assembly may be disposed of without having exposed the user to the primary pouch container or the material contained therein.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims. For instance, although the shear line indicia and shear line depression are considered preferably for the present invention, they are not required. In addition, a cover sheet may or may not be presented in overlying relationship with the base sheet.

Since many possible embodiments may be made of the invention without departing from the scope thereof, it is to be understood that all matter herein set forth or shown in the accompanying drawings is to be interpreted as illustrative, and not in a limiting sense. For example, other shapes, sizes and materials of the assembly and the individual components thereof are contemplated by the inventor.

What is claimed is:

1. A dispensing package assembly, comprising:

a base sheet;

a blister overlay having a main cavity and a secondary cavity opening into said main cavity, said overlay being secured to said base sheet to thereby close said cavities and said secondary cavity including a shear depression extending laterally across and into said secondary cavity to thereby define an area of reduced depth in said secondary cavity; and a dispenser pouch for containing fluent materials, said pouch being confined within-the extent of said overlay substantially within said main cavity and extending into said secondary cavity.

2. A dispensing package assembly as in claim 1, wherein said dispenser pouch has a main body defining an interior containment region and a closed dispensing channel extending outwardly from and opening into said interior containment region, said main body located within said main cavity and said channel extending into said secondary cavity.

3. A package assembly as in claim 1, wherein said pouch is fixed to said base sheet.

4. A package assembly as in claim 1, wherein said secondary cavity has a depth less than that of said main cavity.

5. A package assembly as in claim 1, wherein said blister overlay further includes a dispensing depression protruding downward into said main cavity an extent such that a portion of said dispensing depression is in proximity to said main body of said pouch, and wherein said overlay is formed of a deformable material such that manual pressure applied to said dispensing depression will deform said overlay and compress said main body of said pouch to aid in dispensing material from said pouch.

6. A package assembly as in claim 5, wherein said dispensing depression is in the form of a portion of a sphere having a radius such that said depression extends into sidewalls of said main cavity.

7. A package assembly as in claim 1, further comprising indicia upon said base sheet, said indicia including shear line indicia extending below said secondary cavity of said overlay and said extension of said pouch, whereby shearing along said shear line indicia will cause shearing of at least a portion of said sheet, said overlay and said pouch extension, thereby allowing dispensing of material within said pouch.

8. A package assembly as in claim 1, wherein said shear depression extends to an edge of said secondary cavity.

9. A package assembly as in claim 1, further comprising indicia upon said base sheet, said indicia including shear line indicia extending below said shear depression in said secondary cavity of said overlay and said extension of said pouch, whereby shearing along said shear line indicia will cause shearing of at least a portion of said sheet, said overlay and said pouch, thereby allowing dispensing of material within said pouch, and said shear depression providing a reduced height of said overlay to reduce the force necessary to effect such shearing.

10. A package assembly according to claim 1, wherein said blister overlay additionally comprises a peripheral flange extending outwardly from an opening of said cavities, said overlay being secured to said sheet along said flange to thereby close said cavities.

11. A package assembly as in claim 1, additionally comprising a cover sheet connected to said base sheet along at least one fold line whereby said cover sheet may be folded along said at least one fold line into an opposed position with said base sheet.

12. A package assembly as in claim 11, wherein said package assembly additionally includes means for releasably securing said cover sheet in said opposed position with said base sheet.

13. A dispensing package assembly, comprising:

a base sheet;

a first blister overlay having a main cavity and a secondary cavity opening into said main cavity, said first overlay being secured to said base sheet to thereby close said cavities;

a first dispenser pouch for containing fluent materials, said first pouch being confined within the extent of said first overlay substantially within said main cavity and extending into said secondary cavity;

a cover sheet connected to said base sheet along at least one fold line whereby said cover sheet may be folded along said at least one fold line into an opposed position with said base sheet;

a second blister overlay having a main cavity and a secondary cavity opening into said main cavity, said second overlay being secured to said cover sheet to thereby close said cavities; and a second dispenser pouch for containing fluent materials, said second pouch being confined within the extent of said second overlay substantially within said main cavity and extending into said secondary cavity,

14. A package assembly as in claim 13, whereby said package assembly includes means for releasably securing said cover sheet in said opposed position with said base sheet,

15. A package assembly as in claim 13, wherein each said first and second blister overlays further comprise a shear depression extending laterally across and into said secondary cavities to thereby define an area of reduced depth in said secondary cavities,

16. A package assembly as in claim 15, wherein each said first and second blister overlay further includes a dispensing depression extending into said main cavity an extent such that a portion of said depression is in proximity to said main body of each said first and second pouches respectively, and wherein said overlays are formed of a deformable material such that manual pressure applied to said depression will deform said overlay and compress said main body of said pouch to aid in dispensing material from said pouch.

17. A dispensing package assembly, comprising:

a base sheet;

a blister overlay having a main cavity and a secondary cavity opening into said main cavity, said overlay being secured to said base sheet to thereby close said cavities; and a dispenser pouch for containing fluent materials, said pouch being confined within the extent of said overlay substantially within said main cavity and extending into said secondary cavity, wherein said blister overlay includes a dispensing depression protruding downward into said main cavity and extends such that a portion of said dispensing depression is in proximity to said main body of said pouch.

18. A package assembly as in claim 17 wherein said overlay is formed of a deformable material such that manual pressure applied to said dispensing depression will deform said overlay and compress said main body of said pouch to aid in dispensing material from said pouch.

19. A package assembly as in claim 18 wherein said dispensing depression is in the form of a portion of a sphere having a radius such that said depression extends into sidewalls of said main cavity.

20. A package assembly as in claim 17 wherein said pouch is fixed to said base sheet.

21. A method for applying a pre-measured amount of a fluent composition to a localized area on a mammalian host or other substrate, wherein said method comprises:

opening a package assembly containing said composition by shearing said assembly, wherein said assembly includes a base sheet, a blister overlay having a main cavity and a secondary cavity opening into said main cavity wherein said overlay is secured to said base sheet to thereby close said cavities, and a dispenser pouch containing said composition wherein said pouch is confined substantially within said main cavity and extends into said secondary cavity, the assembly being sheared through at least a portion of said sheet, said overlay and said pouch extension to thereby open said pouch extension;

inverting said sheared assembly such that the opened pouch extension is positioned immediately adjacent said localized area for application thereto; and manually pressing upon said overlay to compress said pouch such that said composition is expelled from said Pouch through said opened pouch extension on to said localized area.

22. A method as in claim 21 wherein said manually pressing step comprises manually pressing upon a dispensing depression provided on said overlay which protrudes downward into said main cavity of said overlay.

23. A method as in claim 21 wherein said opening step comprises opening a package assembly containing said composition by shearing said assembly, wherein said assembly includes a blister overlay having a main cavity and a secondary cavity opening into said main cavity, wherein said secondary cavity includes a shear depression extending laterally across and into said secondary cavity to thereby define an area of reduced depth in said secondary cavity.

24. A method as in claim 21 wherein said opening step further includes opening a package assembly containing said composition by shearing said assembly along shear line indicia, said shear line indicia extending below said secondary cavity of said overlay and said extension of said pouch.

* * * * *